US006918740B2

(12) United States Patent
Liu

(10) Patent No.: US 6,918,740 B2
(45) Date of Patent: Jul. 19, 2005

(54) GAS COMPRESSION APPARATUS AND METHOD WITH NOISE ATTENUATION

(75) Inventor: Zheji Liu, Olean, NY (US)

(73) Assignee: Dresser-Rand Company, Olean, NY (US)

( * ) Notice: Subject to any disclaimer, the term of this patent is extended or adjusted under 35 U.S.C. 154(b) by 88 days.

(21) Appl. No.: 10/352,814

(22) Filed: Jan. 28, 2003

(65) Prior Publication Data

US 2004/0146396 A1 Jul. 29, 2004

(51) Int. Cl.[7] ..... F04D 29/66
(52) U.S. Cl. ..... 415/1; 415/119
(58) Field of Search ..... 415/1, 119, 203, 415/208.2, 208.3, 211.2

(56) References Cited

U.S. PATENT DOCUMENTS

| | | | | |
|---|---|---|---|---|
| 1,783,276 A | | 12/1930 | Bliss | |
| 1,972,563 A | | 9/1934 | Irvin | |
| 3,181,646 A | | 5/1965 | Edwards | |
| 3,286,786 A | * | 11/1966 | Wirt | 29/896.6 |
| 3,360,193 A | | 12/1967 | Harris et al. | |
| 3,850,261 A | * | 11/1974 | Hehmann et al. | 181/286 |
| 3,913,702 A | * | 10/1975 | Wirt et al. | 181/286 |
| 3,948,346 A | | 4/1976 | Schindler | |
| 4,106,587 A | | 8/1978 | Nash et al. | |
| 4,135,603 A | | 1/1979 | Dean, III et al. | |
| 4,137,992 A | | 2/1979 | Herman | |
| 4,150,850 A | | 4/1979 | Doerfling | |
| 4,189,027 A | | 2/1980 | Dean, III et al. | |
| 4,190,131 A | | 2/1980 | Robinson | |
| 4,204,586 A | | 5/1980 | Hani et al. | |
| 4,241,806 A | | 12/1980 | Metzger | |
| 4,244,439 A | * | 1/1981 | Wested | 181/210 |
| 4,287,962 A | | 9/1981 | Ingard et al. | |
| 4,298,090 A | * | 11/1981 | Chapman | 181/286 |

(Continued)

FOREIGN PATENT DOCUMENTS

| | | |
|---|---|---|
| DE | 100 00 418 | 8/2001 |
| DE | 100 03 395 | 8/2001 |
| EP | 1 340 920 | 9/2003 |
| FR | 2 780 454 | 12/1999 |
| GB | 1 511 625 | 5/1978 |
| GB | 2 237 323 | 5/1991 |
| WO | WO 02/052109 | 7/2002 |
| WO | WO 02/052110 | 7/2002 |

*Primary Examiner*—Edward K. Look
*Assistant Examiner*—Igor Kershteyn
(74) *Attorney, Agent, or Firm*—Michael Best & Friedrich LLP

(57) ABSTRACT

A gas compression method and method according to which an impeller rotates to flow fluid through a casing, and a plate is disposed in a wall of the casing. At least one series of cells are formed in the plate to form an array of acoustic resonators to attenuate acoustic energy generated by the impeller.

28 Claims, 2 Drawing Sheets

U.S. PATENT DOCUMENTS 4,303,144 A 12/1981 Wirt
4,421,455 A 12/1983 Tomren
4,433,751 A 2/1984 Bonneau
4,504,188 A 3/1985 Traver et al.
4,531,362 A 7/1985 Barry et al.
4,743,161 A 5/1988 Fisher et al.
4,848,514 A 7/1989 Snyder
4,854,416 A 8/1989 Lalikos et al.
4,858,721 A 8/1989 Autie et al.
4,926,963 A 5/1990 Snyder
4,930,979 A 6/1990 Fisher et al.
4,932,835 A 6/1990 Sorokes
4,944,362 A 7/1990 Motsinger et al.
4,947,958 A 8/1990 Snyder
4,969,535 A * 11/1990 Arcas et al. ..... 181/213
5,007,499 A 4/1991 Ebbing et al.
5,014,815 A 5/1991 Arcas et al.
5,025,888 A 6/1991 Arcas et al.
5,099,566 A 3/1992 Barrett
5,173,020 A 12/1992 Ebbing et al.
5,173,021 A 12/1992 Grainger et al.
5,249,919 A 10/1993 Sishtla et al.
5,340,275 A 8/1994 Eisinger
5,457,291 A 10/1995 Richardson
5,644,918 A 7/1997 Gulati et al.
5,919,029 A 7/1999 Van Nostrand et al.
5,923,003 A 7/1999 Arcas et al.
5,979,593 A 11/1999 Rice et al.
6,082,489 A 7/2000 Iwao et al.
6,135,238 A 10/2000 Arcas et al.
6,196,789 B1 3/2001 McEwen et al.
6,290,022 B1 9/2001 Wolf et al.
6,309,176 B1 10/2001 Periyathamby et al.
6,550,574 B2 4/2003 Liu
6,601,672 B2 8/2003 Liu
6,669,436 B2 12/2003 Liu

* cited by examiner

GAS COMPRESSION APPARATUS AND METHOD WITH NOISE ATTENUATION

BACKGROUND

This invention is directed to a gas compression apparatus and method in which the acoustic energy caused by a rotating impeller of the apparatus is attenuated.

Gas compression apparatus, such as centrifugal compressors, are widely used in different industries for a variety of applications involving the compression, or pressurization, of a gas. These types of compressors utilize an impeller that rotates in a casing at a relatively high rate of speed to compress the gas. However, a typical compressor of this type produces a relatively high noise level, caused at least in part, by the rotating impeller, which is an obvious nuisance and which can cause vibrations and structural failures.

DETAILED DESCRIPTION

Figure 1:
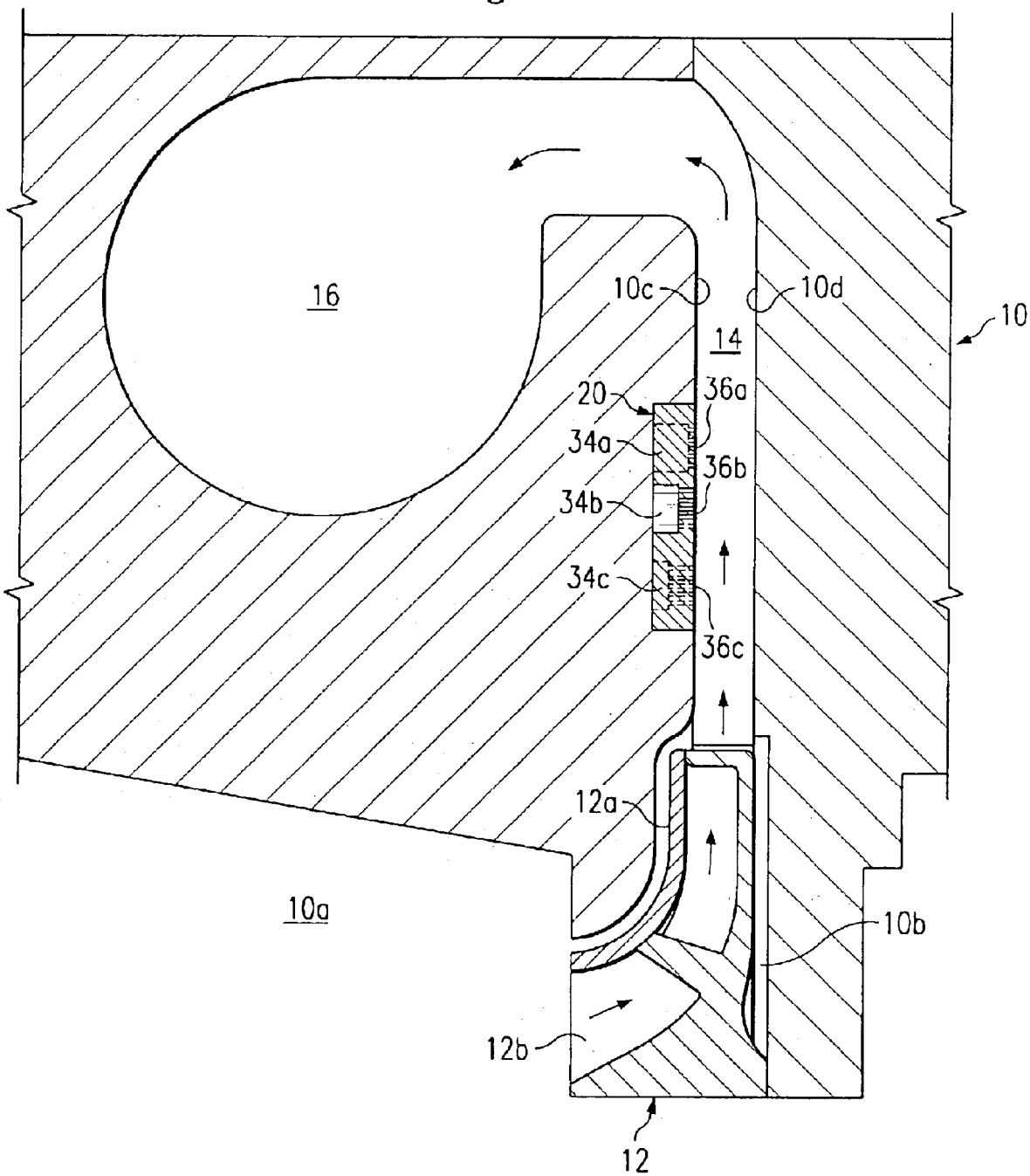
FIG. 1 is a cross-sectional view of a portion of a gas compression apparatus incorporating acoustic attenuation according to an embodiment of the present invention.

FIG. 1 depicts a portion of a high pressure, gas compression apparatus, such as a centrifugal compressor, including a casing 10 having an inlet 10*a* for receiving a fluid to be compressed, and an impeller cavity 10*b* for receiving an impeller 12 which is mounted for rotation in the cavity. It is understood that a power-driven shaft (not shown) rotates the impeller 12 at a high speed, sufficient to impart a velocity pressure to the gas drawn into the casing 10 via an inlet 10*a*. The casing 10 extends completely around the shaft and only the upper portion of the casing is depicted in FIG. 1.

The impeller 12 includes a plurality of impeller blades 12*a* (one of which is shown) arranged axi-symmetrically around the latter shaft and defining a plurality of passages 12*b*. Due to centrifugal action of the impeller blades 12*a* and the design of the casing 10, gas entering the impeller passages 12*b* from the inlet 10*a* is compressed to a relatively high pressure before it is discharged into a diffuser passage, or channel, 14 extending radially outwardly from the impeller cavity 10*b* and defined between two annular facing interior walls 10*c* and 10*d* in the casing 10. The channel 14 receives the high pressure gas from the impeller 12 before the gas is passed to a volute, or collector, 16 also formed in the casing 10 and in communication with the channel. The channel 14 functions to convert the velocity pressure of the gas into static pressure, and the volute 16 couples the compressed gas to an outlet (not shown) of the casing. It is understood that conventional labyrinth seals, thrust bearings, tilt pad bearings and other similar hardware can also be provided in the casing 10 which function in a conventional manner and therefore will not be shown or described.

An annular plate 20 is mounted in a recess, or groove, formed in the interior wall 10*a*, with only the upper portion of the plate being shown, as viewed in FIG. 1. As better shown in FIG. 2, a plurality of relatively large-diameter cells, or openings, three of which are shown in FIG. 2 and referred to by the reference numerals 34*a*, 34*b* and 34*c*, are formed through one surface of the plate 20.

Also, a plurality of series of relatively small-diameter cells, or openings, three of which are shown and referred to by the reference numerals 36*a*, 36*b* and 36*c*, are formed through the opposite surface of the plate. Each cell in the series 36*a* bottoms out, or terminates, at the bottom of the cell 34*a* so that the depth of the cell 34*a* combined with the depth of each cell of the series 36*a* extend for the entire thickness of the plate 20. The series 36*b* is associated with the cell 34*b*, and the series 36*c* is associated with the cell 34*c* in an identical manner. The number of cells in each series 36*a*, 36*b*, and 36*c* can vary according to the application and they can be randomly disposed relative to their corresponding cells 34*a*, 34*b*, and 34*c*, respectively, or, alternately, they can be formed in any pattern of uniform distribution.

The cells 34*a*, 34*b*, and 34*c*, and the cells of the series 36*a*, 36*b*, and 36*c* can be formed in any conventional manner such as by drilling counterbores through the corresponding opposite surfaces of the plate 20. As shown in FIG. 1, the cells 34*a*, 34*b*, and 36*c* are capped by the underlying wall of the aforementioned groove formed in the casing 10, and the open ends of the cells in the series 36*a*, 36*b*, and 36*c* communicate with the diffuser channel 14.

Figure 2:
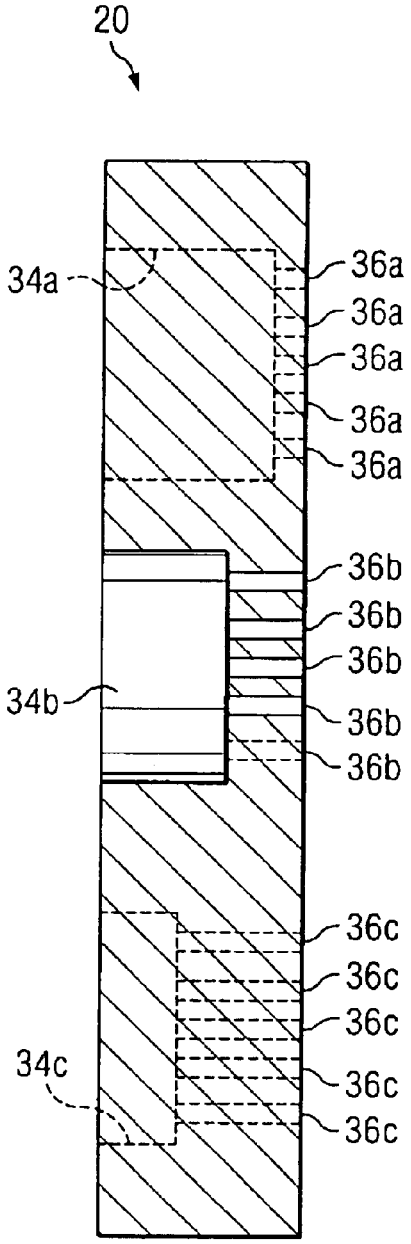
FIG. 2 is an enlarged cross-sectional view of a base plate of the apparatus of FIG. 1.

As better shown in FIG. 2, the depth, or thickness of the plate 20 is constant over its entire area and the respective depths of the cells 34*a*, 34*b*, and 34*c*, and the cells in the series 36*a*, 36*b*, and 36*c* and 36 vary in a radial direction relative to the plate 20. In particular, the depths of the cells 34*a*, 34*b*, and 34*c* decrease from the radially outer portion of the plate 20 (the upper portion as viewed in FIG. 2) to the radially inner portion of the plate. Thus, the depths of the cells of the series 36*a*, 36*b*, and 36*c* increases from the radially outer portion to the radially inner portion of the plate 20.

Although only three large-diameter cells 34*a*, 34*b*, and 34*c* and three series of small-diameter cells 36*a*, 36*b*, and 36*c* are shown and described herein, it is understood that additional cells are provided that extend around the entire surfaces of the annular plate 20.

In operation, a gas is introduced into the inlet 10*a* of the casing 10, and the impeller 12 is driven at a relatively high rotational speed to force the gas through the inlet 10*a*, the impeller cavity 10*b*, and the channel 14, as shown by the arrows in FIG. 1. Due to the centrifugal action of the impeller blades 12*a*, the gas is compressed to a relatively high pressure. The channel 14 functions to convert the velocity pressure of the gas into static pressure, and the compressed gas passes from the channel 14, through the volute 16, and to the outlet of the casing 10 for discharge.

Due to the fact that the cells in the series 36*a*, 36*b*, and 36*c* connect the cells 34*a*, 34*b*, and 34*c* to the diffuser channel 14, all of the cells work collectively as an array of acoustic resonators which are either quarter-wave resonators or Helmholtz resonators or in accordance with conventional resonator theory. This significantly attenuates the sound waves generated in the casing 10 caused by the fast rotation of the impeller 12, and by its interaction with diffuser vanes in the casing, and eliminates, or at least minimizes, the possibility that the noise will by-pass the plate 20 and pass through a different path.

Moreover, the dominant noise component commonly occurring at the passing frequency of the impeller blades 12*a*, or at other high frequencies, can be effectively lowered by tuning the cells 34*a*, 34*b*, and 34*c*, and the cells in the series 36*a*, 36*b*, and 36*c* so that the maximum sound attenuation occurs around the latter frequency. This can be achieved by varying the volume of the cells 34*a*, 34*b*, and 34*c*, and/or the cross-sectional area, the number, and the depth of the cells in the each series 36*a*, 36*b*, and 36*c*. Also, given the fact that the frequency of the dominant noise component varies with the speed of the impeller 12, the number of the cells in each series 36*a*, 36*b*, and 36*c* per each larger cell 34*a*, 34*b*, and 34*c*, respectively, can be varied spatially across the plate 20 so that noise is attenuated in a relatively broad frequency band. Consequently, noise can be efficiently and effectively attenuated, not just in constant speed devices, but also in variable speed devices.

In addition, the employment of the acoustic resonators, formed by the cells 34*a*, 34*b*, and 34*c* and the cells in the series 36*a*, 36*b*, and 36*c*, in the plate, as a unitary design, preserves or maintains a relatively strong structure which has little or no deformation when subject to mechanical and thermal loading. As a result, these acoustic resonators have no adverse effect on the aerodynamic performance of the gas compression apparatus.

Figure 3:
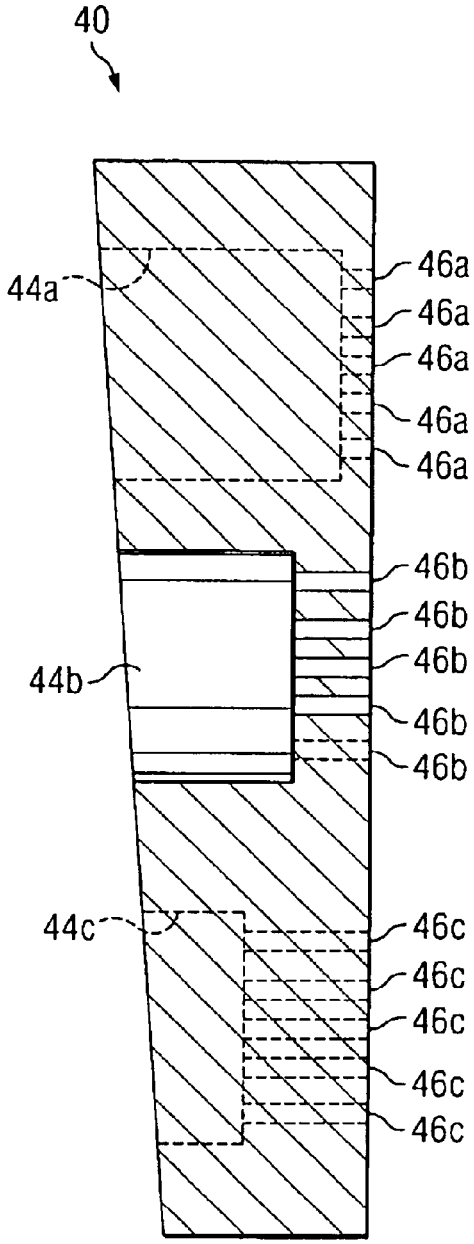
FIG. 3 is a view, similar to that of FIG. 2, but depicting an alternate embodiment of the base plate of FIG. 2.

An alternate version of the plate 20 is depicted in FIG. 3 and is referred to, in general, by the reference numeral 40. The plate 40 is mounted in the same manner and at the same location as the plate 20 and only the upper portion of the plate is shown in FIG. 3. The depth, or thickness, of the plate 40 decreases from the radially outer portion of the plate (the upper portion as viewed in FIG. 3) to the radially inner portion of the plate.

A plurality of relatively large-diameter cells, or openings, three of which are shown in FIG. 3 and referred to by the reference numerals 44*a*, 44*b* and 44*c*, are formed through one surface of the plate 40. Also, a plurality of series of relatively small-diameter cells, or openings, three of which are shown and referred to by the reference numerals 46*a*, 46*b* and 46*c*, are formed through the opposite surface of the plate.

Each cell in the series 46*a* bottoms out, or terminates, at the bottom of the cell 44*a* so that the depth of the cell 44*a* combined with the depth of each cell of the series 46*a* extend for the entire thickness of the corresponding portion of the plate 40. The series 46*b* is associated with the cell 44*b* and the series 46*c* is associated with the cell 44*c* in an identical manner. The number of cells in each series 46*a*, 46*b*, and 46*c* can vary according to the application, and the latter cells can be randomly disposed relative to their corresponding cells 44*a*, 44*b*, and 44*c*, respectively or, alternately, can be formed in any pattern of uniform distribution.

The cells 44*a*, 44*b*, and 44*c*, and the cells of the series 46*a*, 46*b*, and 46*c* can be formed in any conventional manner such as by drilling counterbores through the corresponding opposite surfaces of the plate 40. As in the case of the plate 40 of FIG. 2 the cells 44*a*, 44*b*, and 46*c*, when placed in the casing 10, are capped by the underlying wall of the aforementioned groove formed in the casing 10, and the open ends of the cells in the series 46*a*, 46*b*, and 46*c* communicate with the diffuser channel 14.

The respective depths of the cells 44*a*, 44*b*, and 44*c*, and the cells in the series 46*a*, 46*b*, and 46*c* increase with the thickness of the plate 40 from the radially outer portion of the plate (the upper portion as viewed in FIG. 3) to the radially inner portion of the plate.

Although only three large-diameter cells 44*a*, 44*b*, and 44*c* and three series of small-diameter cells 46*a*, 46*b*, and 46*c* are shown and described in connection with the embodiment of FIG. 3, it is understood that they extend around the entire surfaces of the annular plate 40.

Thus, the plate 40, when mounted in the casing 10 in the same manner as the plate 20 enjoys all the advantages discussed above in connection with the plate 20.

Variations and Equivalents

The specific technique of forming the cells 34*a*, 34*b*, 34*c*, 44*a*, 44*b*, and 44*c* and the cells in the series 36*a*, 36*b*, 36*c*, 46*a*, 46*b*, and 46*c* can vary from that discussed above. For example, a one-piece liner can be formed in which the cells are molded in their respective plates.

The relative dimensions, shapes, numbers and the pattern of the cells 34*a*, 34*b*, 34*c*, 44*a*, 44*b*, and 44*c* and the cells in the series 36*a*, 36*b*, 36*c*, 46*a*, 46*b*, and 46*c* can vary.

The above design is not limited to use with a centrifugal compressor, but is equally applicable to other gas compression apparatus in which aerodynamic effects are achieved with movable blades.

The plates 20 and 40 can extend for 360 degrees around the axis of the impeller as disclosed above; or it can be formed into segments each of which extends an angular distance less than 360 degrees.

The spatial references used above, such as "bottom," "inner," "outer," "side," "radially outward," "radially inward," etc., are for the purpose of illustration only and do not limit the specific orientation or location of the structure.

Since other modifications, changes, and substitutions are intended in the foregoing disclosure, it is appropriate that the appended claims be construed broadly and in a manner consistent with the scope of the invention.

What is claimed is:

1. A gas compression apparatus comprising a casing having an inlet for receiving gas; an impeller disposed in the casing for receiving gas from the inlet and compressing the gas; a plate disposed in a wall of the casing defining a diffuser channel in the casing; and at least one series of cells formed in the plate to form an array of resonators to attenuate acoustic energy generated by the impeller, the depth of the cells varying along the plate.

2. The apparatus of claim 1 wherein the plate is annular and wherein the depth of each cell varies from the radially outward portion of the plate to the radially inward portion.

3. The apparatus of claim 1 wherein a first series of cells extends from one surface of the plate, and a second series of cells extends from the opposite surface of the plate, the size of each cell of the first series of cells being greater than the size of each cell in the second series of cells.

4. The apparatus of claim 3 wherein the cells in the second series of cells extend to the cells in the first series of cells.

5. The apparatus of claim 3 wherein the cells are in the form of bores formed in the plate, and wherein the diameter of each bore of the first series of cells is greater than the diameter of the bore of the second series of cells.

6. The apparatus of claim 5 wherein one cell of the first series of cells is associated with a plurality of cells of the second series of cells.

7. The apparatus of claim 5 wherein the plate is annular and wherein the depth of each cell varies from the radially outward portion of the plate to the radially inward portion.

8. The apparatus of claim 7 wherein the depth of each cell of the first series of cells decreases from the radially outward portion of the plate to the radially inward portion.

9. The apparatus of claim 8 wherein the depth of the each cell of the second series of cells increases from the radially outward portion of the plate to the radially inward portion.

10. The apparatus of claim 7 wherein the thickness of the plate increases from the radially outward portion of the plate to the radially inward portion.

11. The apparatus of claim 10 wherein the depth of the each cell of the first and second series of cells increases from the radially outward portion of the plate to the radially inward portion.

12. The apparatus of claim 3 wherein the first series of cells extends from the surface of the plate facing the diffuser channel.

13. The apparatus of claim 1 wherein a volute is formed in the casing in communication with the diffuser channel for receiving the pressurized gas from the diffuser channel.

14. The apparatus of claim 1 wherein the number and size of the cells are constructed and arranged to attenuate the dominant noise component of acoustic energy associated with the apparatus.

15. The apparatus of claim 1 wherein the resonators are either Helmholtz resonators or quarter-wave resonators.

16. A gas compression method comprising introducing gas into an inlet of a casing; compressing the gas in the casing; passing the compressed gas to a volute in the casing for discharging the compressed gas; and forming at least one series of cells formed in a plate in the casing to form an array of resonators to attenuate acoustic energy generated during the step of compressing, the depth of the cells varying along the plate.

17. The method of claim 16 wherein the plate is annular and wherein the depth of each cell varies from the radially outward portion of the plate to the radially inward portion.

18. The method of claim 16 wherein a first series of cells extends from one surface of the plate, and a second series of cells extends from the opposite surface of the plate to the first series of cells, the size of each cell of the first series of cells being greater than the size of each cell in the second series of cells.

19. The method of claim 18 wherein the cells in the second series of cells extend to the cells in the first series of cells.

20. The method of claim 18 wherein the cells are in the form of bores formed in the plate, and wherein the diameter of each bore of the first series of cells is greater than the diameter of the bore of the second series of cells.

21. The method of claim 20 wherein one cell of the first series of cells is associated with a plurality of cells of the second series of cells.

22. The method of claim 18 wherein the plate is annular and wherein the depth of each cell varies from the radially outward portion of the plate to the radially inward portion.

23. The method of claim 22 wherein the depth of each cell of the first series of cells decreases from the radially outward portion of the plate to the radially inward portion.

24. The method of claim 23 wherein the depth of each cell of the second series of cells increases from the radially outward portion of the plate to the radially inward portion.

25. The method of claim 22 wherein the thickness of the plate increases from the radially outward portion of the plate to the radially inward portion.

26. The method of claim 25 wherein the depth of each cell of the first and second series of cells increases from the radially outward portion of the plate to the radially inward portion.

27. The method of claim 16 wherein the number and size of the cells are constructed and arranged to attenuate the dominant noise component of acoustic energy associated with the method.

28. The method of claim 16 the resonators are either Helmholtz resonators or quarter-wave resonators.

* * * * *